United States Patent [19]

Atkinson

[11] 4,453,387

[45] Jun. 12, 1984

[54] TRUNK TYPE LOCK WITH THROW AWAY KEY

[75] Inventor: Wallace E. Atkinson, Petersburg, Va.

[73] Assignee: Long Manufacturing Co., Inc., Petersburg, Va.

[21] Appl. No.: 344,808

[22] Filed: Feb. 1, 1982

[51] Int. Cl.[3] ..... A45C 13/12; E05B 11/00; E05B 19/08; E05B 19/26; E05B 65/48

[52] U.S. Cl. ..... 70/75; 70/389; 70/399; 70/410; 70/414; 70/422

[58] Field of Search ..... 70/75, 399, 410, 417, 70/414, 422, 389, 69–74; 24/211 R; 292/3, 34, 37

[56] References Cited

U.S. PATENT DOCUMENTS

| | | | |
|---|---|---|---|
| 785,526 | 3/1905 | Simpson | 70/422 |
| 873,481 | 12/1907 | Aliano | 70/75 |
| 1,853,403 | 4/1932 | Briggs | 70/417 |
| 2,382,756 | 8/1945 | Wagner et al. | 70/75 |
| 2,819,603 | 1/1958 | Levine | 70/74 |
| 3,103,114 | 9/1963 | Atkinson | 70/71 |
| 3,184,935 | 5/1965 | Atkinson | 70/75 |
| 3,338,078 | 8/1967 | Eberitch et al. | 70/395 |

FOREIGN PATENT DOCUMENTS

| | | | |
|---|---|---|---|
| 635650 | 12/1927 | France | 70/399 |
| 136106 | 11/1919 | United Kingdom | 70/70 |

*Primary Examiner*—Thomas J. Holko
*Assistant Examiner*—Lloyd A. Gall
*Attorney, Agent, or Firm*—Mason, Fenwick & Lawrence

[57] ABSTRACT

A trunk lock including a latching plate for attachment to the upper section of a trunk, a hasp member hinged to an attachment plate to be affixed to the lower trunk section having a free end portion to overlie a keeper opening in the latching plate, a hollow cylindrical bolt housing projecting rearwardly of the hasp to nest in the keeper opening and having a pair of spring biased latching bolts to interlock behind the bounding edge of the keeper opening, a bolt actuator disk and key barrel member in the housing, and a throw away key captured in assembled relation with the bolt housing having a blade including a major leg extending substantially along the center axis of said key barrel and having a bendable end tab protruding rearwardly of the housing and bent behind the rear of the housing to retain the key therein.

10 Claims, 6 Drawing Figures

TRUNK TYPE LOCK WITH THROW AWAY KEY

BACKGROUND AND OBJECTS

The present invention relates in general to trunk locks, and more particularly to key operated trunk locks having facility for manual release of the lock from latched condition when the trunk secured by the lock is accessible to operation by potential customers on a sales floor.

Heretofore, it has been customary for trunk locks to close automatically. In trunk locks of such construction, the bolts or plungers on the hasp of the trunk lock are customarily spring loaded and beveled so that the locking mechanism, when mated with its latching or keeper plate, locks itself by engaging the plungers or bolts in corresponding cavities or keeper recesses in the latching plate. In such an arrangement, a key must be used to open the lock. This construction of trunk locks has been inconvenient to both the retailer and to the consumer, due to the fact that a key is required each time it is desired to open the trunk for inspection. In conventional trunks of this construction, the key is frequently stored inside the trunk, necessitating the production of duplicate keys or forcing of the lock to gain access to the trunk. When trunks having such conventional trunk lock construction are stored or displayed in retail establishments, it has been the custom in many cases for the keys to be attached by a string to the trunk handle, and a significant proportion become detached and lost from their associated trunks through accident or pilfering. Also, at the retail level, the keys attached by string to the trunk handle are frequently placed on the inside of the trunk through careless handling, thus producing a lock out.

Heretofore, a trunk lock construction has been disclosed in earlier U.S. Pat. No. 3,184,935, granted to the assignee of the present application, wherein the lock may be opened from an automatic latched condition without the use of the key, by means of a manually operated, "C" shaped loop or bail pivotally coupled to a portion of the lock, so that the operating bail may be pivoted outwardly and rotated by the hand of the user about the rotary axis of the key cylinder portion of the lock to move the lock to unlocked condition.

An object of the present invention is the provision of a novel trunk lock construction having a pair of spring loaded beveled bolts or plungers on a hinged hasp which automatically latch with a cooperating latching plate, and wherein a throw away key is captured in the rotatable cylinder portion of the trunk lock by a bendable tab on the inner end of the key, permitting the lock to be manually opened on a sales floor or similar situation, and wherein the customer can bend the tab on the innermost end of the key to a position permitting withdrawal of the key so that the regular key which is given to the customer at the time of purchase can be used thereafter to operate the trunk lock.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figures 1, 2, 3, 4, 5, 6:
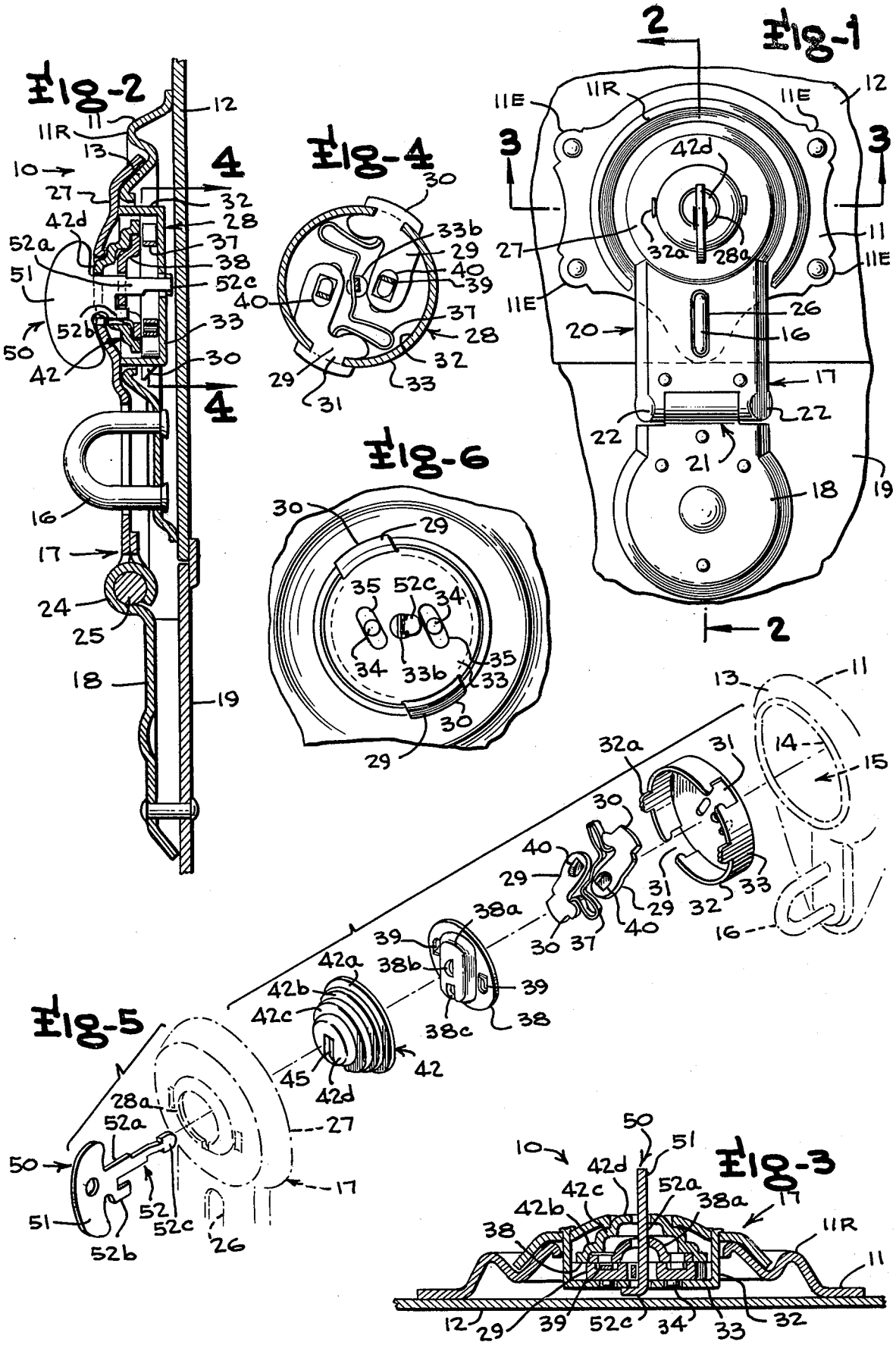
FIG. 1 is a front elevational of a trunk lock embodying the present invention shown in mounted position on adjacent portions of a trunk.
FIG. 2 is a vertical sectional view thereof taken along the line 2—2 of FIG. 1.
FIG. 3 is a horizontal sectional view taken along the line 3—3 of FIG. 1.
FIG. 4 is a vertical section view of the lock mechanism casing and internal components thereof taken along the line 4—4 of FIG. 2.
FIG. 5 is an exploded perspective view of the lock mechanism portion of the hasp.
FIG. 6 is a rear elevational view of the lock mechanism casing with the key captured therein and showing adjacent portions of the hasp.

Referring to the drawings, wherein like reference characters designate corresponding parts throughout the several figures, the trunk lock of the present invention is indicated generally by the reference character 10 and includes a latching plate or keeper plate 11 of conventional configuration adapted to be affixed to one of the separable trunk sections, for example the lid or upper trunk section 12, and having the usual outwardly converging truncated conical annular ramp wall portion 13 terminating in a rim 14 bounding the circular keeper opening 15. Outwardly surrounding the annular conical ramp portion 13 is a raised interrupted ring formation, indicated at 11R, resembling an escutcheon plate ring, and apertured ear formations 11E extend radially outwardly beyond this raised interrupted ring formation 11R for receiving the usual rivets by which the keeper is fixed to the trunk section wall 12. In the illustrated embodiment, a padlock staple 16 is also formed on the keeper plate 11 below and generally aligned with the center of the keeper opening 15.

Cooperating with the latching plate 11 is a hasp assembly 17 of conventional configuration including an attaching plate or mounting plate 18 adapted to be affixed to the other separable trunk section, for example the lower trunk body 19, and includes a pivoted hasp member 20 connected by means of a conventional hinge connection 21 to the mounting plate 18. The hinge connection 21 may, for example, be formed by a pair of laterally spaced knuckle formations 22 on the hasp member 20 laterally flanking an opening or recess sized to receive a loop formation 24 at the bottom of the pivoted hasp member 20, which receives a hinge pin 25 whose ends extend into the knuckle formations 22. The hasp member 20 has an elongated slot 26 in the intermediate region of the hasp member to receive the padlock staple 16 therethrough and has a somewhat enlarged rounded and truncated conically shaped upper end portion 27 which overlies the keeper opening 15 and the bounding raised conical portion 13 of the keeper plate 11 when the trunk lock is in closed position.

The latch mechanism 28 is carried by the enlarged rounded upper end portion 27 of the hasp member 20, and includes a pair of aligned reciprocating bolts or plungers 29 of like configuration having beveled end portions 30 projecting through diametrically opposite openings 31 in the cylindrical wall 32 of a cup shaped bolt housing 33 which projects inwardly toward the trunk from the enlarged end portion 27 of the hasp and is of appropriate size to be received within the round keeper opening 15. The bolts 29 are guided for movement along axes paralleling a diameter of the bolt housing 33 by sliding engagement of the lateral edges of the bolt end portions 30 with the lateral edges of the openings 31 in the bolt housing cylindrical wall 32 and by pin-like projections 34 on the opposite or radially inward ends of the bolts 29 extending in the slots 35 in the circular rear wall 36 of the bolt housing 33. The bolts 29 are continuously urged radially outwardly by a spring 37 and are limited in their outward movement by engagement of shoulders at appropriate points along the sides of the bolts with the lateral edges of the bolt openings 31 in the bolt housing cylindrical wall 32.

To effect retraction of the bolts 29 to unlatching condition, an actuator disk 38 is provided, which is disposed forwardly of the bolts 29 within the cylindrical bolt housing 33 and, in the illustrated embodiment, has a diameter substantially smaller than the inner diameter of the cylindrical wall 32 of the bolt housing. The actuator disk 38 has a pair of rearwardly extending bent driving tabs 39 located eccentrically of the center axis of the actuator disk 38 substantially symmetrically spaced to opposite sides of the center of the disk and located so as to project into aligned, forwardly facing sockets 40 formed in the bolts 29. The actuator disk is rotatably supported in concentric relation with the cylindrical bolt housing by a dome-like key barrel member 42 having a peripheral flange portion **42*a* and a forwardly bowing dome portion which is terraced in two stages by annular terraces or flats 42*b* and 42*c* arranged in parallel planes perpendicular to the center axis of the barrel member 42. The terraces define a first larger diameter cylindrical well portion whose diameter corresponds to that of the actuator disk 38 to receive the disk 38 in nested relation therein to rotatably constrain the disk 38 in concentric relation in the barrel member 42, a second cylindrical well portion of intermediate diameter corresponding to the outer diameter of the forwardly pressed or distorted bulge formation 38*a* of the actuator disk 38 which has convex opposite arcuate end portions extending along paths concentric with the center axis of the disk and conforming to the confronting cylindrical surface of the intermediate well, and a forwardmost cylindrical portion 42*d* whose diameter corresponds to that of the center opening 28*a* of the round enlarged end formation 27 of the hasp member 20 to be rotatably journaled therein. The key barrel member 42 has a key slot 45 therein and the forwardly pressed bulge portion 38*a* of the actuator disk 38 has a center hole 38*b* for the center portion of a key and a second key hole 38*c* eccentrically spaced from the center key hole 38*b* to receive a second portion of a key bit. The bolt housing 33 with the barrel member 42, actuator disk 38, spring 37 and bolt members 29 nested therein is assembled in rearwardly extending relation to the enlarged circular end portion 27 of the hasp member by mounting lug formations 32*a* which project a short distance forwardly from the rearmost edge of the bolt housing cylindrical wall 32 into diametrically opposed slots in the circular enlarged end portion 27 of the hasp 20 as shown and are deformed at their forwardmost edges to assemble the bolt housing 33 to the hasp member 20**.

If desired, a further locking bar of the configuration illustrated in said earlier U.S. Pat. No. 3,184,935, there indicated by reference character 48, may be associated with an actuator disk and a key cylinder member, there indicated by reference characters 53, 38 and 43 respectively, of slightly different configuration from the actuator disk and key barrel member herein illustrated and described, to provide for positive locking by the bolt member of the key cylinder in the manner described in the earlier patent.

The trunk lock of either of the types described above is provided with a throw away key, indicated generally by the reference character 50, designed to be captured in the key slot 45 of the barrel member 42, and comprises an enlarged handle or hilt portion, indicated at 51, which may be for example of the vertically elongated and rounded configuration shown, or any other desired configuration providing a substantially flat, thin key handle or hilt, together with a rearwardly projecting blade or shank portion 52. In the illustrated embodiment, the blade is bifurcated and, prior to initial insertion in the trunk lock by the lock manufacturer or trunk manufacturer, is a flat planiform blade and provides a major, longer leg **52*a* adjacent the uppermost edge of the blade or shank portion 52 when the key is in the initial insertion or "12:00 o'clock" position to be aligned with the center axis of the key barrel member 42, and a minor, shorter laterally offset leg portion 52*b* which is located eccentrically below the center axis of the key barrel member 42. The major longer leg 52*a* is of a length to extend all the way through the cylindrical bolt housing 33 and through the rear exit center opening 33*b* therein, and is provided with a bendable end tab 52*c* at the rearmost end of the major leg 52*a* which is designed to be bent at right angles to the major plane of the key blade 52 immediately behind the rear wall of the bolt housing 33 when inserted in the trunk lock to be captured therein to overlap a portion of the rear housing wall as illustrated in FIG. 6 and capture the key in the key slot of the key barrel 42**.

In this condition with the key 50 captured in the key barrel member by the bent over tab **52*c*, the handle or hilt of the key may be grasped by any potential customer on the sales floor and rotated in the usual manner to cause the lock to move to unlocked or unlatched condition. This is achieved by the two laterally offset major and minor legs 52*a*, 52*b* of the key blade portion interfitting in the openings or holes 38*b* and 38*c* in the actuator disk 38 causing the actuator disk 38 to rotate with the key, along with the key barrel member 42 whose slot 45 receives the key blade. This rotation of the actuator disk through the action of the drive tab formations 39 interposed in the sockets 40 of the bolt members 29 retracts the bolt members toward each other against the action of the spring 37 and withdraws the ends 30 of the bolt members 29 from behind the rim 14 of the keeper opening 15, thus freeing the hasp member 20 for opening movement about the hinge connection 21**.

To move the trunk lock to a latched condition, the operator merely pivots hasp member 20 about the hinge 21 in a direction to project the bolt housing 33 into the keeper opening 15, during which the beveled ends 30 of the bolt members 29 abut the rim 14 and cam inwardly and then snap outwardly underneath the rim 14.

When it is desired to remove the captured throw away key 50 from the trunk lock at the time of delivery of the proper keys for the trunk lock to the purchaser, the salesman or the purchaser simply pries the bendable terminal lug formation **52*c* on the end of the major leg 52*a* rearwardly to substantially align with the extended plane of the key blade portion 52**, and the throw away key is then withdrawn from the key slot and disposed of.

I claim:

1. In a lock for trunks or the like having separable upper or lower sections, a latching plate for attachment to the upper section of the trunk having a circular keeper opening therein, a hasp assembly having an attachment plate to be affixed to the lower trunk section, a hasp member hinged to the attachment plate having a free end portion to overlie said keeper opening and adjacent portions of the latching plate when in mated position, a hollow cylindrical bolt housing of cup-shaped configuration fixed to and projecting rearwardly of the hasp member to nest in the keeper opening when the hasp member and latching plate assume the mated position, a pair of spring biased latching bolts supported in the bolt housing for movement to and from projected positions to interlock behind latching plate portions bounding the keeper opening when the hasp member is in said mated position, an actuator disk concentrically rotatable about a center axis of the cylindrical housing having members intercoupled with the latching bolts to withdraw them to an unlocked position upon rotation of the actuator disk through a selected arc, and a key barrel member positioned forwardly adjacent the actuator disk having a key slot therein; the improvement comprising a throw away key captured in assembled relation with the cylindrical bolt housing having a blade portion extending through said key slot in the key barrel and a handle portion disposed externally forwardly adjacent the hasp member, the key blade portion having a major leg extending substantially along the center axis of said key barrel and actuator disk and cylindrical housing and a driver formation displaced eccentrically of said center axis to engage surface portions of the actuator disk and impart rotation to the actuator disk upon rotation of the key, said actuator disk and cylindrical housing having openings to receive said major leg of the key blade therethrough, said key blade portion being an integral one-piece blade member bendable transversely to the major plane of the blade portion and said major leg thereof having a bendable end tab portion integral with the remainder of the blade portion protruding through said center opening of said cylindrical housing and normally disposed in capturing position extending substantially perpendicular to said center axis behind and immediately adjacent rear wall portions of said cylindrical housing to capture the key in actuator disk operating condition, and said bendable end tab portion being bendable into substantial longitudinal axial alignment with said major leg permitting withdrawal of the throw away key from the bolt housing and the key slot of said key barrel.

2. In a lock for trunks and the like as defined in claim 1, said cylindrical bolt housing having guide surfaces for guiding movement of said bolt members along axes paralleling a diameter of the bolt housing, said bolt members having forwardly facing sockets therein, and said actuator disk being of thin sheet metal having rearwardly deformed driver tab members pressed rearwardly therefrom extending into the sockets of said bolt members.

3. In a lock for trunks and the like as defined in claim 1, wherein said actuator disk is carried within said bolt housing by the hasp member and rotatable about an axis adapted to be aligned with the center axis of the keeper opening when the hasp member is in mated position therewith, said actuator disk having eccentric drive elements thereon extending rearwardly therefrom and intercoupled with said bolt members to withdraw the bolt members to a release position upon rotation of the actuator disk through a selected arc.

4. In a lock for trunks and the like as defined in claim 1, the key barrel member being a forwardly bowed, generally dome-like member journaled by said hasp member for rotation about the center axis of said bolt housing and defining a well shaped to rotatably journal said actuator disk about its center axis.

5. In a lock for trunks as defined in claim 4, said generally dome shaped key barrel member being of terraced configuration providing three rearwardly opening cylindrical recesses of stepped forwardly reducing diameters, the forwardmost smallest diameter portion thereof being journaled in a circular opening in said hasp member and rearwardly spaced larger diameter recesses thereof defining cylindrical surfaces journaling said actuator disk for rotation about its center axis.

6. In a lock for trunks as defined in claim 1, said key being a substantially planiform member defining handle and blade portions to be disposed in a vertical plane at an insertion position of the key into the key slot of said key barrel, the blade portion of said key being shaped to define an elongated narrow major leg extending entirely through said cylindrical bolt housing and terminating in said end tab portion protruding rearwardly beyond said housing and bent laterally of the major plane of the planiform key to rearwardly lap portions of the bolt housing adjoining the center opening for said major leg, the key including a second minor leg displaced eccentrically from the longitudinal center axis of said major leg and forming said driver formation extending into an opening therefor in said actuator disk to cause rotation of the actuator disk about its axis upon rotation of the key.

7. In a lock for trunks as defined in claim 2, said key being a substantially planiform member defining handle and blade portions to be disposed in a vertical plane at an insertion position of the key into the key slot of said key barrel, the blade portion of said key being shaped to define an elongated narrow major leg extending entirely through said cylindrical bolt housing and terminating in said end tab portion protruding rearwardly beyond said housing and bent laterally of the major plane of the planiform key to rearwardly lap portions of the bolt housing adjoining the center opening for said major leg, the key including a second minor leg displaced eccentrically from the longitudinal center axis of said major leg and forming said driver formation extending into an opening therefor in said actuator disk to cause rotation of the actuator disk about its axis upon rotation of the key.

8. In a lock for trunks as defined in claim 3, said key being a substantially planiform member defining handle and blade portions to be disposed in a vertical plane at an insertion position of the key into the key slot of said key barrel, the blade portion of said key being shaped to define an elongated narrow major leg extending entirely through said cylindrical bolt housing and terminating in said end tab portion protruding rearwardly beyond said housing and bent laterally of the major plane of the planiform key to rearwardly lap portions of the bolt housing adjoining the center opening for said major leg, the key including a second minor leg displaced eccentrically from the longitudinal center axis of said major leg and forming said driver formation extending into an opening therefor in said actuator disk to cause rotation of the actuator disk about its axis upon rotation of the key.

9. In a lock for trunks as defined in claim 4, said key being a substantially planiform member defining handle and blade portions to be disposed in a vertical plane at an insertion position of the key into the key slot of said key barrel, the blade portion of said key being shaped to define an elongated narrow major leg extending entirely through said cylindrical bolt housing and terminating in said end tab portion protruding rearwardly beyond said housing and bent laterally of the major plane of the planiform key to rearwardly lap portions of the bolt housing adjoining the center opening for said major leg, the key including a second minor leg displaced eccentrically from the longitudinal center axis of said major leg and forming said driver formation extending into an opening therefor in said actuator disk to cause rotation of the actuator disk about its axis upon rotation of the key.

10. In a lock for trunks as defined in claim 5, said key being a substantially planiform member defining handle and blade portions to be disposed in a vertical plane at an insertion position of the key into the key slot of said key barrel, the blade portion of said key being shaped to define an elongated narrow major leg extending entirely through said cylindrical bolt housing and terminating in said end tab portion protruding rearwardly beyond said housing and bent laterally of the major plane of the planiform key to rearwardly lap portions of the bolt housing adjoining the center opening for said major leg, the key including a second minor leg displaced eccentrically from the longitudinal center axis of said major leg and forming said driver formation extending into an opening therefor in said actuator disk to cause rotation of the actuator disk about its axis upon rotation of the key.

* * * * *